US008387986B2

(12) United States Patent
Baker

(10) Patent No.: US 8,387,986 B2
(45) Date of Patent: Mar. 5, 2013

(54) TEXAS HOLD'EM WITH ADDITIONAL FEATURES

(76) Inventor: Michael D. A. Baker, Ellicott City, MD (US)

( * ) Notice: Subject to any disclaimer, the term of this patent is extended or adjusted under 35 U.S.C. 154(b) by 587 days.

(21) Appl. No.: 12/618,556

(22) Filed: Nov. 13, 2009

(65) Prior Publication Data

US 2011/0115159 A1 May 19, 2011

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 5,046,736 A * 9/1991 Bridgeman et al. ..... 463/13
5,823,873 A * 10/1998 Moody ..... 463/13
6,007,066 A * 12/1999 Moody ..... 273/292
6,098,985 A * 8/2000 Moody ..... 273/292
6,110,040 A * 8/2000 Sanduski et al. ..... 463/13
6,196,918 B1 * 3/2001 Miers et al. ..... 463/13
6,652,377 B1 * 11/2003 Moody ..... 463/13
6,749,500 B1 * 6/2004 Nelson et al. ..... 463/13
6,935,952 B2 8/2005 Walker et al.
6,964,418 B2 * 11/2005 Moody ..... 273/292
7,222,857 B2 * 5/2007 Moody ..... 273/292
7,296,799 B1 11/2007 Baker
7,306,521 B2 12/2007 Toyoda
7,410,171 B1 * 8/2008 Holmdal ..... 273/292
7,748,714 B2 * 7/2010 Nicely et al. ..... 273/292
2006/0131810 A1 * 6/2006 Nicely ..... 273/292
2009/0051113 A1 2/2009 Moody

* cited by examiner

*Primary Examiner* — Kurt Fernstrom
*Assistant Examiner* — Dolores Collins
(74) *Attorney, Agent, or Firm* — Marvin A Motsenbocker; Mots Law, PLLC

(57) ABSTRACT

Texas Hold'em is played between human and virtual machine players on electronic equipment. The virtual players fold up and the human does not. This allows the human to see the hold cards of the opponents and adds excitement to the game. Optionally, the human player gets a bonus for having a good hand regardless of who wins the pot. The bonus also adds excitement and interest. Preferably the virtual players have personalities. By creating a minimum number of personalities and changing personalities with players, user interest is maintained. In particular, adding these features to a Texas hold'em game with fold up procedure for virtual opponents increases user excitement.

2 Claims, 5 Drawing Sheets

TEXAS HOLD'EM WITH ADDITIONAL FEATURES

FIELD OF THE INVENTION

The invention relates to poker games generally and more specifically to electronic versions of Texas Hold'em.

BACKGROUND OF THE INVENTION

Of all card games ever known, poker is most popular. A variety of poker, called "Texas Hold'em" is often enjoyed by groups of players who share some of the same cards to make up a hand. Texas Hold'em is played with a minimum of two players and usually up to a maximum of ten players. A standard 52-card deck is used, a deck with four suits, Clubs, Diamonds, Hearts and Spades, each having thirteen cards, 2, 3, 4, 5, 6, 7, 8, 9, 10, Jack, Queen, King and Ace. The deck is shuffled before each hand. Players enter an ante before receiving cards.

When play starts, each player receives two cards face down as "hole cards." Five cards then are displayed face up and are used by all players. These are "community" cards. Players may combine any five of their two hole cards and five community cards to make the best five-card poker hand. Ranking of hands is conventional, with the highest hand a 10, Jack, Queen, King and Ace on-suit (the highest straight-flush) and the lowest potential winning hand comprising high cards (in the absence of a pair or better hand). Two or more players may tie, and each receive an equal share from the betting pot. All suits are equal in determining a winner. A flush of one suit against a flush of the same cards in another suit results in a tied hand. Variations of these rules exist and are contemplated, but too numerous to list here.

Generally, the player to the left of the dealer must bet 'in the blind' before any cards are dealt. In some games, two or more blinds are required and no blind bidding is used. After the blinds (if any) are posted, two hole cards are dealt 'down' (hidden), and only played as part of the recipient's hand. After this, each player clockwise from the blind bettor(s) may call the blind bet(s), raise or fold. Players that have bet 'in the blind' optionally can raise their blind bets on the first round of betting, with the farthest-clockwise-away blind bettor the last to bet in the initial betting round. If only one player remains (others folded) then the sole player is declared the winner and receives the pot.

After the first round of betting, the first three community cards are simultaneously displayed (the 'flop'). Then each remaining player, starting with the first player to the left, may check, bet, call, raise, re-raise (re-raises may be limited to three in any round) or fold. The betting round ends when no more bets or raises can be made that have not been called or responded to by an all-in or fold.

A fourth community card (the "turn") is then displayed and betting proceeds for the remaining 'in' players as described above. Finally, a fifth community card is displayed (the 'river'), and betting proceeds for the remaining 'in' players. After the river betting round, the last bettor's hole cards are opened and 'read' to determine the strength of that hand when combined with the five community cards. The same reading of hands is done in clockwise order with respect to the hole cards of each remaining player. The winner(s) are declared and the pot distributed.

Minor regional variations to the game are known, which are not included in the above description. These are not critical to understanding the principal embodiments described but may be combined in some embodiments. For example, the house/casino often takes a 'rake,' to profit from the game. The rake may be implemented in a machine game version by skipping or discounting the ante or call(s) of a virtual player, or the house may simple take a percentage of each hand. A casino or poker site generally does not bet with players but charges players a fee for hosting/supervising the game.

Often, betting limits increase after the "turn" (described below) is dealt. At any time, to "call," a player must enter the amount of the bet(s) made in that betting round prior to his turn. If a player bets his whole stack,—which is less than the bet(s) prior to or after his turn—another player's exposure to that player is equal only to the amount of that player's whole stack invested in the pot. As to such a player, known as "all in," and the player(s) he competes with through the "river" (described below), players who later fold not being considered, the hand will always be fully dealt out, with a winner declared, using all community cards. After a player or players go "all in," betting can continue by other players. When this happens, separate "side" pots can be created for the players who continue betting and calling one another. These side pots are won by the continuing players, and in these hands two or more players can be declared winners (even if the 'all in' player makes the best hand, the continuing player with the next highest hand will win the side pot).

New Versions of the Game

Versions of Texas Hold'em are known, such as that invented by Michael Baker and described in U.S. Pat. No. 7,296,799, which is identical to regular Texas Hold'em except that opponents hands are folded facing up. This innovation allows a player to better predict the remaining cards and also see more of the strategy used by a player. The innovation of folding with showing the folded cards works well and is exciting.

Generally, "folding up," as described and broadly claimed in U.S. Pat. No. 7,296,799 provides greater excitement. This technique adds more interest to the game. It was discovered however, that many human players do not like this version because they are shy about revealing their hole cards. Any technique that addresses this problem would benefit the game by creating more player interest.

Electronic implementation of Texas hold'em often compromises on betting by virtual players. See, for example, US No. 20090051113 by Ernest Moody. Presumably because of computer limitations, this version does not include independent betting by other, virtual players via a computer. Yet another problem is that an enjoyable game with 4 or more independent players has been difficult to achieve where one person plays the game on a single machine. Unfortunately, in many if not most games many players are not dealt what they consider to be playable hands. Accordingly, in many circumstances, three or fewer players play a hand beyond what is called the pre-flop stage (before any community cards are turned up). Thus, much of the Texas hold'em experience merely consists of a bet (providing an ante) that the two hole cards will be playable. In a fast action game provided on an electronic machine, the rapid ante (and/or initial betting) followed by rapid folding can consume much wagering resources, without allowing the player to enter the later, interesting stages of the game. Any device or method that counteracts this tendency or that increases user interest at this stage can add greater enjoyment to the game and is highly desirable.

SUMMARY

One object of the invention is to create greater player interest and stimulation by allowing the showing of hole cards from folded virtual players, while preserving house odds. Another object is to create greater player interest and stimulation by allowing greater opportunities for a player to win, even when the player loses an overall hand. Another object is to minimize the problem of rapid betting on hole cards followed by folding. Other objects will be appreciated by a reading of the specification.

One or more of these objects are realized by a method that displays positions of the player and the virtual opponents on a visual display; accepts a wager from the player and wagers from the virtual opponents; displays two hole cards face up to the player; displays two hole cards face down to each virtual opponent; accepts player input of at least checking or making a wager, with each virtual opponent responding with at least one of folding, checking or raising; displays a first, second and third community card face up; accepts player input of at least checking or making a wager, with each virtual opponent responding with at least one of folding, checking or raising; displays a fourth and fifth community card face up; accepts player input of at least checking or making a wager, with each virtual opponent responding with at least one of folding, checking or raising; stops play when the player inputs a fold decision; and determines the poker hand ranking of the player's best final five cards, and each virtual opponent's best final five cards using each of the respective player or virtual opponent's two hole cards and the five community cards; wherein when a virtual opponent folds, the hole cards of the virtual opponent are displayed to the player, but the virtual opponents do not remember any displayed hole cards for determining strategy in subsequent bidding.

DETAILED DESCRIPTION

Embodiments of the invention are played on an apparatus. A variety of apparatuses are suitable. For example, a home computer with keyboard and/or mouse input that runs a program that implements algorithms or strategies described here, may be employed for home, office or recreational location use. A home computer or other computing device may be attached to a network or internet and provide player inputs (and optionally game display outputs). A dedicated slot machine or other gaming machine having at least a. an input for receiving money; b. a visual display that indicates the player's hand; c. one or more inputs from the player to indicate a bet, a raise, a check and a fold; and d. a stored program that carries out steps for implementing a Texas Hold'em may be used. The machine or stored program additionally preferably includes a fold up procedure only for virtual players and not for human player(s), provision of half back of the ante to the player if surrendered before the flop, bonus accumulation by the player regardless of winning the pot, and/or generation and use of virtual player personalities, as described herein.

Figure 1:
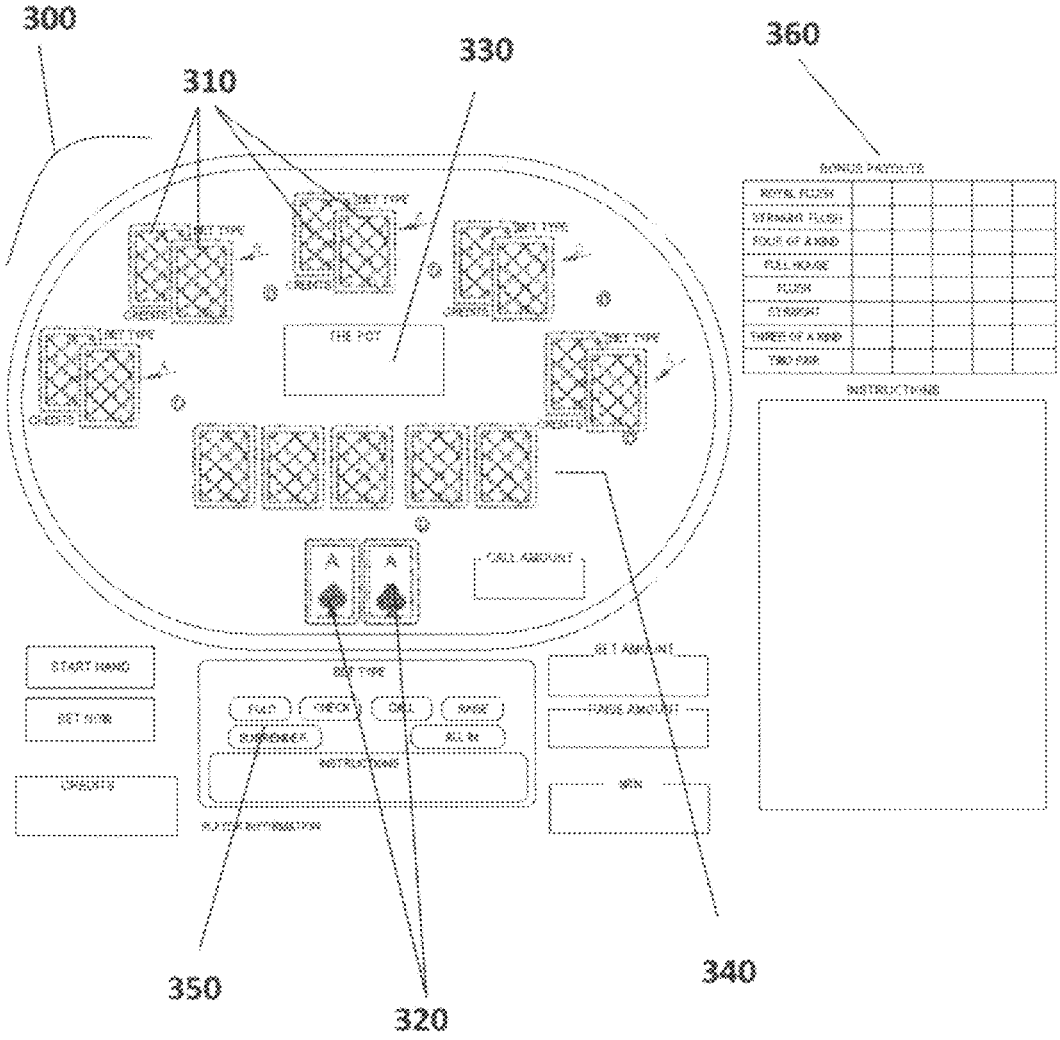
FIG. 1 is a representative screen display according to an embodiment.

FIG. 1 shows a preferred display for a user, which conveniently may be implemented on a personal computer, slot machine or other apparatus. This figure shows oval playing table 300, with cards distributed in a user friendly manner as shown. Virtual player hole cards 310 (representing cards for two virtual players) are face down, player (i.e. "human player" or "user") hole cards 320 are face up, and pot 330, which displays the total wagering for a game is shown in the center. Community cards 340 (5 are shown) appear horizontally in turn underneath the pot. Appearance of surrender button 350 on the left side is linked to software routines that show the status of use of the half back provision and bonus payout table 350 preferably is at the upper right side as shown.

This particular look and feel, particularly with the detailed bonus display, which shows pair, two pair, full house, flush, straight and royal straight flush is an embodiment that stimulates a great deal of player interest. In particular, provision of multiple bonus value categories as shown here, during a Texas hold'em game is an important discovery for Texas hold'em players. An embodiment therefore is a game, played on a slot machine, computer terminal or other display device, that displays a. hole cards of virtual players face down, b. hole cards of the user face up, c. community cards of a Texas hold'em game face up, and d. a bonus feature that shows an accumulated bonus. In a related embodiment, the accumulated bonus is presented as a progressive display of increased value as shown in FIG. 1. Another embodiment is a stored program that is capable of directing a video display as described above, when operating in a computer or other microprocessor device. Another embodiment is a screen display itself, as described here.

The particular look and feel, particularly with the surrender button, which shows the status or availability of the half back provision is an embodiment that stimulates a great deal of player interest. In particular, the half back provision indicator as shown here, during a Texas hold'em game is an important discovery for Texas hold'em players. An embodiment therefore is a game, played on a slot machine, computer terminal or other display device, that displays a. hole cards of virtual players face down, b. hole cards of the user face up, c. community cards of a Texas hold'em game face up, and d. a half back provision feature such as a surrender button. Another embodiment is a stored program that is capable of directing a video display as described above, when operating in a computer or other microprocessor device. Another embodiment is a screen display itself, as described here. Yet another embodiment is a combination of the accumulated bonus display feature along with the display of the half back bonus feature.

Other embodiments that may be used include, for example, a mix of multiple human players with virtual players and internet based distributive processing wherein at least some if not all computations occur at one or more sites remote from a human player having a remote player terminal.

Embodiments of the invention also include memory storage devices that contain a copy of an instruction set for carrying out any of the embodiments described herein. For example, a software program for implementing: a. the fold up routine for virtual player opponents but not human player; and/or b. a bonus feature for the human player's hand that returns a bonus regardless of who wins the pot; and/or c. a half back provision that returns half of a human player's ante, may be stored on a memory stick, a DVD, a CD, a computer readable memory, an MP3 player, a cell phone, a netbook computer, a laptop, a desktop, an internet browsing computer, a server or other device or material. Such stored version can be bought, sold or traded, even in encrypted form. Such memory containing device loaded with the instruction set has value and is a contemplated embodiment of the invention.

Figure 2:
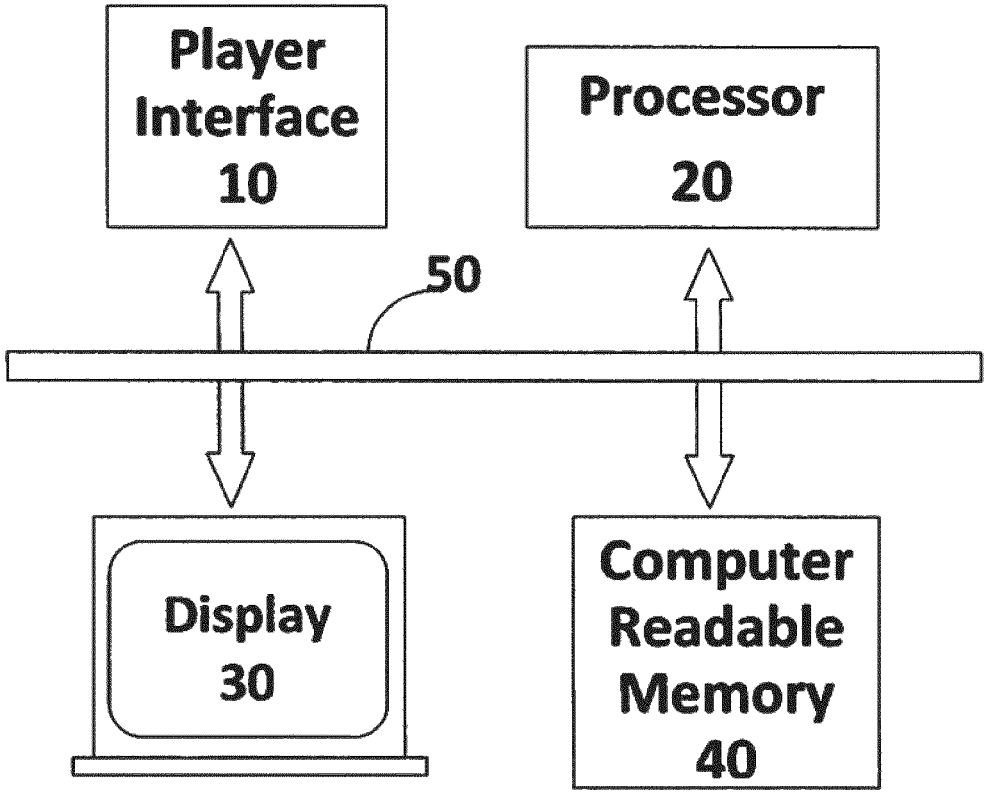
FIG. 2 is an outline of an apparatus according to an embodiment.

Generally (see FIG. 2), in each case above, a player interface 10 accepts input from the player, a display 30 shows cards and other status to the player, a processor 20 carries out the stored program and some kind of memory 40 is used by processor. The components 10, 20, 30 and 40 may be combined within a single apparatus, such as a slot machine or may be separated into two or more locations. For example, a terminal may include just interface 10 and display 30 and portions of memory and one processor out of several used to execute stored programs. Optional added features may include for example, money or credit inputs, provision of visual images of players' faces matched with personalities as described, for example in U.S. Pat. No. 7,306,521, and combination with real card shuffles and play. A variety of combinations are contemplated in embodiments.

Software Implemented on a Variety of Machines

An embodiment provides a stored program that is executed on a machine with one or more inputs and/or outputs as described herein. In a particularly desirable embodiment software is loaded into a personal computer, executes on that computer and provides game play. Optionally, the software additionally contacts a network such as a local area network or the internet to receive approval to execute one or more subroutines or to establish and monitor payment for use of the software.

Whether on a user stand-alone computer, on a network (such as the internet) or at a gambling parlor as in a slot machine, a software program preferably runs on a microprocessor, responds to at least one user input such as betting decisions, and directs video output, such as a display represented in FIG. 1. The program preferably carries out one or more of the functions shown in FIGS. 2 to 5.

An embodiment is a stored program that is capable of executing play of Texas hold'em with at least one human player and 2 or more virtual players as described herein and that additionally includes one or more subroutines for at least one of: a. the fold up routine for virtual player opponents but not for human players; b. a bonus feature for the human player's hand that returns a bonus regardless of who wins the pot; and c. a half back provision that can return half of a human player's ante. Other embodiments include the use of personalities for virtual players. Preferably, the stored program is loaded into a computer or microprocessor accessible random access memory and then executed with numerous inputs and outputs that accept human player decisions for betting, raising, folding or calling; and that outputs at least one signal that indicates one of a dealt card, a virtual player decision, and a video screen output.

Basic Fold Up Play

In an embodiment, a player plays Texas hold'em with fold up feature, wherein the problem of shyness in folding and showing cards to others is eliminated by only seeing the cards of opponents. This advantageous feature provides an unexpectedly desirable fold up procedure via the steps of: 1. a human "player" plays against virtual opponents only; 2. the player does not fold up, but instead when he folds, all play stops and his cards are never shown; 3. the virtual opponents do not ever "see" the player's folded cards, and do not ever rely on knowledge of those cards for strategy. That is, when making betting decisions in the future, such decisions are not informed by knowledge of the human player's cards. No human player and no virtual player learns the hole cards of the human player because he plays against virtual opponents only and all play stops when he folds. Desirably, virtual players used in embodiments have personalities and are not predicable and furthermore are changed to prevent learning of these personalities by the human player.

This combination alleviates a shyness problem associated with the manual fold up play procedure popularized by Baker, inventor of U.S. Pat. No. 7,296,799, the contents of which, and particularly the method steps, are hereby incorporated by reference. In a desirable embodiment, the human player is no longer shy because his cards are not really shown to anyone, yet he can see the folded up cards of his opponents.

In desirable embodiments, this special fold up procedure, which avoids player shyness optionally is coupled with new excitement engendering procedures that provide: 1) a return of one half back of the ante and 2) a bonus to the player regardless of who wins the pot. These two extra procedures are described next. In an embodiment, the user can select between different configurations of play. That is, the game can be played as a regular Texas hold'em or derivative of Texas hold'em with 1) selective fold up of virtual opponent procedure as described here, 2) return one half back of ante, 3) bonus feature, and 4) a combination of 1-3. In an embodiment that may be played over the internet, the player might decides among one or more of these combinations before starting play, and the odds may be adjusted accordingly. For example, when half back of ante and/or bonus are included with fold up, the house may decrease or remove the ante of one or more virtual opponents.

In one embodiment, a home software game is provided with one or more of these features and the home user selects which set of features to play with. In yet another embodiment, the software provides suggestions for using the half back provision or how to bet, preferably as a visual indication of probabilities to the player, at one or more steps of play. For example, after receiving two hole cards, the stored program may output a video report of percentage chance of winning a pot, or merely provide a broad suggestion to fold, raise or call. After one or more community cards are played, further information, such as modification of probability of winning, can be further provided. In this way, operation of the stored program can be used as a learning tool.

The program or its use can be rented as well. A stored program on a computer readable media can be physically exchanged at a rental shop and returned there, for example. A user also could play or rent, and optionally receive detailed suggestions through such play over the internet. The stored program can be used as teaching device, by combining at least one audio visual output recommendation to the user for each betting situation.

Generally, internet versions preferably are implemented wherein most if not all of the computations, and in particular, random number generation of cards, and decision making of virtual players, are located at a remote (i.e. local server, server at another node of the internet, telephone link to a physically remote server, etc). When renting or subscribing to such service, the user typically pays a fee or acquires an access code, and a stored set of instructions are downloaded for interpretation of commands from a remote program, and to handle user input and output. Most preferably the stored program set of instructions received over the internet cover user input of betting decisions and display output commands and/or subroutines but card dealing and virtual player activities are generated at another location, such as another server linked at a remote node on the internet or other network. See U.S. Pat. No. 6,935,952, which teaches a remote gaming system wherein a player can gamble against a wagering establishment or lottery from a remote location on a personal computer, or portable device that does not require an on-line connection with a host computer associated with the wagering establishment. The methods, software and devices described in this patent relating to implementation of methods described herein particularly are incorporated by reference.

In an embodiment, the stored program is executed in a slot machine having a touch screen. The touch screen displays a gaming table as for example, exemplified by FIG. 1. All subroutine outputs to the player and inputs from the player preferably are under control of one or more microprocessors within the slot machine. An independent slot machine would have all computations and method steps executed within the same slot machine apparatus. However, in another embodiment, one or more slot machines are linked to a central server, which monitors and controls card dealing. In another embodiment, real cards are shuffled and dealt, and optionally video images are shown.

In yet another embodiment, at least two human players play the same game. The features of one half back ante, and/or bonus is included as part of the play. One or more virtual players also may be included. In an embodiment only the virtual players fold up but the human players fold down. In yet another embodiment, any of the embodiments described herein may include a video image output of a virtual player as a face, top torso, or other visual indication of a player, as for example seen in U.S. Pat. No. 7,306,521. In an embodiment, a delay time to decide a bet for the virtual player can be modulated by operation of a stored program in accordance with a personality type as well. In an embodiment, audio indications from a virtual player, such as grunts, laughs, and other sounds recognizable as coming from a human, additionally may be employed. Stored program subroutines may be prepared and executed for linking sounds and images with personality types to make the game more interesting and specifically are contemplated. Such methods and machine components for audio and visual outputs as described in U.S. Pat. No. 7,306,521 specifically are incorporated by reference.

Play Before the Flop: Return One Half Back of Ante

Figure 3:
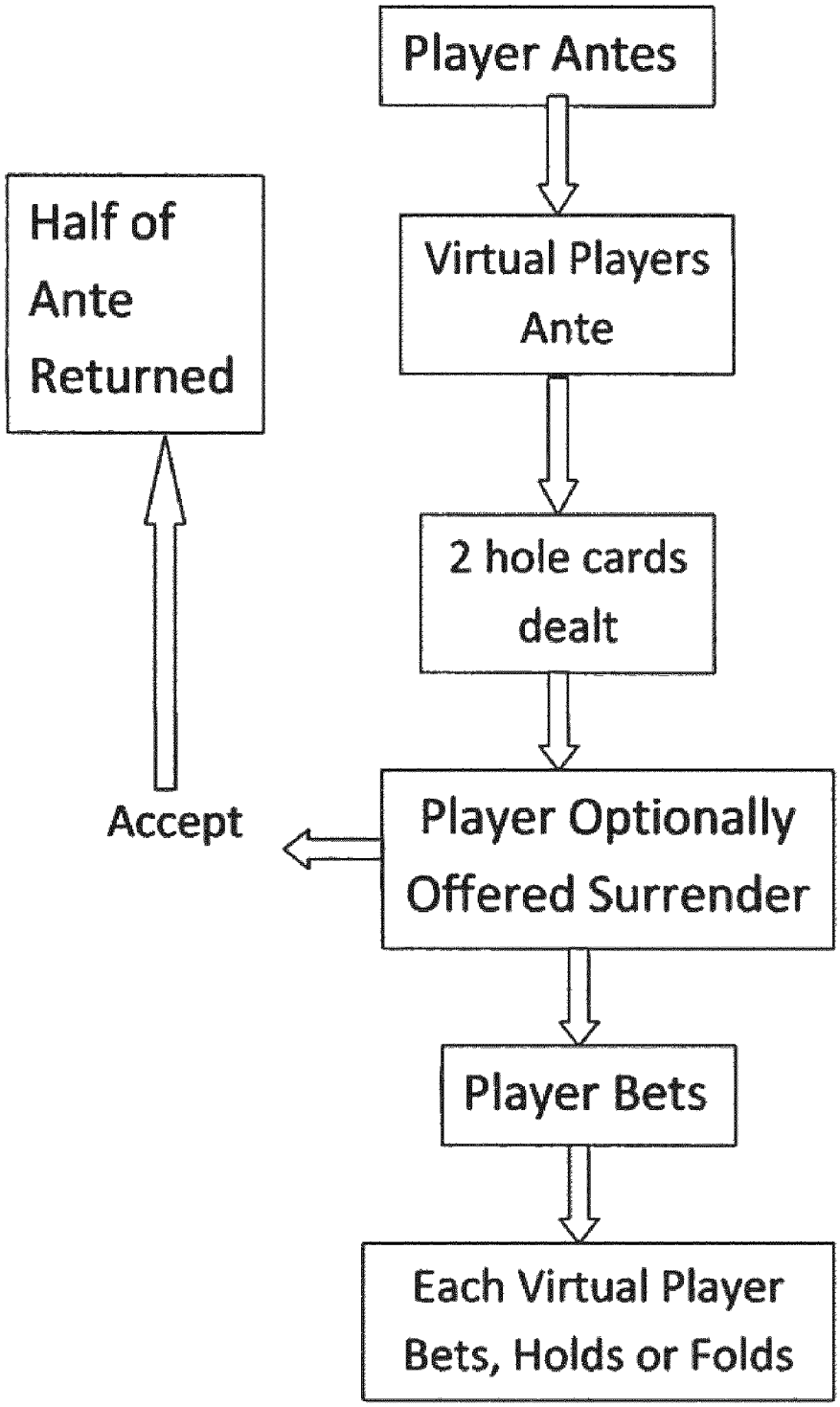
FIG. 3 is an outline of a software that returns half of an ante according to an embodiment.

In a desirable embodiment user interest is enhanced after receiving hole cards after ante by allowing the user to fold before the flop and returning half of the ante to the user. This can provide faster action and maintain longer user play time. FIG. 3 shows a representative step process that generally can be implemented as software subroutines or subroutine parts, for each step. In FIG. 3, user input 210 triggers the start of a game. Input 210 preferably is an ante wherein the user selects an ante amount. After input 210, other virtual players enter antes. Preferably each virtual player simply matches the user ante amount.

The hole cards are next drawn in step 220. Card shuffling and administration is controlled by a random number generator as is well known in the art. The hole cards of a human player preferably are displayed as shown in FIG. 1 and other optional players may use their own terminals or screens. One or more rounds of betting preferably occur after receiving the two hole cards. In a most desirable embodiment, the human player is allowed to fold and recover half of his ante at this point (step 230 in FIG. 3). In an embodiment, the software only prompts this possibility if the user hole card combination is below a specific poker ranking cut off, which may be programmed for example as a look up table or algorithm. In a desirable embodiment, the hole cards are displayed from any virtual player that folds.

In an embodiment, a display symbol or other visual indicator is presented on the user screen or other readout device, to indicate the status of the optional one half back feature. For example, a box, button, window, or other image may be displayed. An example of this is shown as the button labeled "surrender" in FIG. 1. Preferably the image(s) or symbol(s) or other visual indicator of the one half back feature is presented at the bottom or side of the playing game as exemplified here. An embodiment is a stored program that executes a Texas hold'em game with a subroutine that displays a one half back indication in or near the game window at a time of most interest, such as when the hole cards are deemed of low value, by a subroutine comparison of their value from a stored table versus a fixed cutoff value. Such display provides greater interest and excitement and is particularly preferred.

A light, flashing light, separated image or other symbol also may be used with or even instead of the display mentioned above. A sound such as a buzzer, chime, bell, song, whistle, or any other noise may be used to announce the presence of the one half back feature and/or selection of this feature. A stored program that operates a method as described herein may have one or more subroutines and/or outputs for signaling the display signal before a game, during a game, and most preferably, after payment of the ante and especially after delivery of the hole cards to the player and rounds of betting wherein a virtual player has just raised a bet.

In an embodiment, the stored program calculates a relative or absolute value of the players hole cards with respect to a maximum possible value and then offers the player one half back by presentation of the display symbol or other visual indicator, preferably along with a sound. For example, the stored program may store the identity of the two user hole cards at specific random access memory locations, then compare the hole cards with a list of possible hole card combinations as exemplified in Table 1, and then determine an absolute or relative value. If the determined value is below a threshold poker strength scoring value then the stored program can output a signal to the user that the user can stop and receive a half back on the ante, and execute a subroutine to look for user input to determine whether the user takes advantage of this feature. If the user bets instead, then the subroutine is terminated, as not needed.

Table 1 is a list of percent probabilities of a winning hand based on hole cards, if played to the river. Winning probabilities for play against each of 1 to 9 opponents is listed here. The symbols are self-explanatory. If both cards are the same suit, this fact is denoted by an appended "s." For example, "AA" means a pair of aces, "AKs" means an ace and king of the same suit. A "predicted break even point" is defined as the probability of winning, based on this table, adjusted by the number of players, to a break even point. The percentage chance of winning is divided by the number of players to get the break even point. If the players total two, then 50% chance of winning equals the predicted break even point. For example hole cards of a Jack and a five in the same suit ("J5s" on this table) have a predicted winning percentage of 50% when played against one player and 20% when played against 4 players, and would be right at the predicted break even point. On the other hand, hole cards of 87s (eight and seven of the same suit) have predicted winning percentages of 48.2 percent (less than predicted break even point) against one player and 22 percent (greater than predicted break even point) against 4 players. Based on the predicted break even point, a player personality (betting behavior based on hand strength) may be set or determined objectively.

Table 1 is one preferred table of values to set a reference personality after dealing of the hole cards and prior to the flop. The "reference personality" is an objective condition wherein betting decisions are made based on "playing the cards" for maximum payoff. A large variety of other methods and tables can be used, but in each case, a probability, similar to that seen here is employed at some step to make a determination of whether to call, raise or fold. In a desirable embodiment, a reference personality changes with play by accommodating new information. For example, if a virtual player folds, then the number of total players will drop by one, and the odds would be adjusted accordingly. If a player folds up, then the exposed cards are examined, In other words the stored program a. inputs the card identities (stores in memory location), b. updates the probability table by removing winning possibilities that require the folded cards, and c. recalculates the values in the table.

The method of generating a reference personality and then generating other personalities from this by adjusting one or more personality parameters such as propensity to fold, to call, to raise, to bluff, etc. and then giving a different personality to each of at least two different virtual players is a particularly desirable embodiment. More preferably, at least two of the generated personalities are changed (rotated for example) among virtual players after or before each game.

If the hole card combination predicted winning hand value is much higher (e.g. at least 10% higher, at least 20% higher and especially at least 30% higher) than the predicted break even point, then a raise would be expected if the player did not bluff. For example when playing against 4 others, hole cards of "99" (pair of nines, different suits) has a predicted winning percentage value of 32.6, which when compared with the 20% break even point is 32.6/20 or 63% higher than the 20% break even point. If the hole card combination predicted winning hand value is much lower (e.g. at least 10% lower, at least 20% lower and especially at least 30% lower) than the predicted break even point, then a fold would be expected if the player did not bluff. For example, when playing against 5 others, a player's hole cards of "T2" (ten and two, different suits) has a predicted winning hand value of 10.6%. This can be compared with the 16.6% break even point for 5 opponents (6 players total equals 16.6% chance for each at the break even point), to give 10.6/16.6 or 36% lower than the break even point.

A variety of alternative methods for determining hand strength are contemplated for this embodiment. A similar objective table of predictions can be made or inferred for each of the later stages as mentioned above. For example, after the flop, betting behavior of others can be ignored to eliminate personality factors but one or two additional objective factors can be used to create probability table(s) such as: 1. amount of the pot and 2. hole cards exposed by virtual players folding up. For example, if the pot is unusually large and one or more players have folded, then the value of a winning hand is greater, and a greater amount of bet is acceptable to stay in the game. A wide variety of calculations can be made on the basis of exposed hole cards and can be devised by skilled artisans who are mathematicians in the poker field.

In each case, a relative strength of the player's chances is based on his hole cards, and both hole cards together with any displayed community cards preferably are used to set a betting behavior. A skilled artisan readily can derive or look up algorithms or look up tables in a method step of ascertaining the quality of a hand at any stage of the game. At the stage just before the flop, however, the information of Table 1 in look up form is especially preferred, for a player to decide how to bet. In an embodiment, a personality of a virtual player can be characterized by behavior at this betting stage (after receiving both hole cards but before the flop) because of the ease in using Table 1 to objectively determine chances of winning a pot.

The stored program also can use Table 1 to inform the player (or to decide whether to allow the player) to stop and get one half back, prior to the flop. For example, if the player's hole cards are "32" (three and two of separate suits) and there are 4 opponents, the chances of winning a pot is only 10.6%, which is more than 50% less than the break even point of 20% for 5 total players. The stored program in an embodiment, may cause an output (visual and/or audio) to the user that informs the relative or absolute chances of winning and offer the chance to take one half back. In another embodiment, the program does not provide this information but merely looks for the user to input a decision to take one half back.

Play After the Flop, Player Bonus

If the user does not surrender or fold, a round of betting (step 240 in FIG. 3) ensues. In a desirable embodiment, the hole cards are displayed from any virtual player that folds. Then 3 community cards are played face up (i.e. exposed) in the "flop" (see FIG. 3). The flop is followed by a round of betting, as represented by step 310. In a desirable embodiment the hole cards are displayed from any virtual player that folds.

In a desirable embodiment (see FIG. 5), player interest and excitement is enhanced by provision of a bonus to the human player after the flop. In this instance, if the player's hole cards combined with the 3 community cards make up a good hand, a bonus is awarded, even if the player folds, and regardless of who wins the pot. For example, in one embodiment, if the player has two pair or better, the player receives a bonus commensurate with the hand strength. Three of a kind returns a higher bonus than two pair for example, with the largest bonus being the best hand possible: a royal straight flush. In an embodiment the bonus can increase as the hand becomes progressively better with continued play. The bonus preferably is calculated and displayed instantly, and awarded at the end of a hand. Preferably a position on the display screen displays the amount of bonus continuously as shown in the upper right box ("BONUS PAYOUTS") of FIG. 1.

Figure 5:
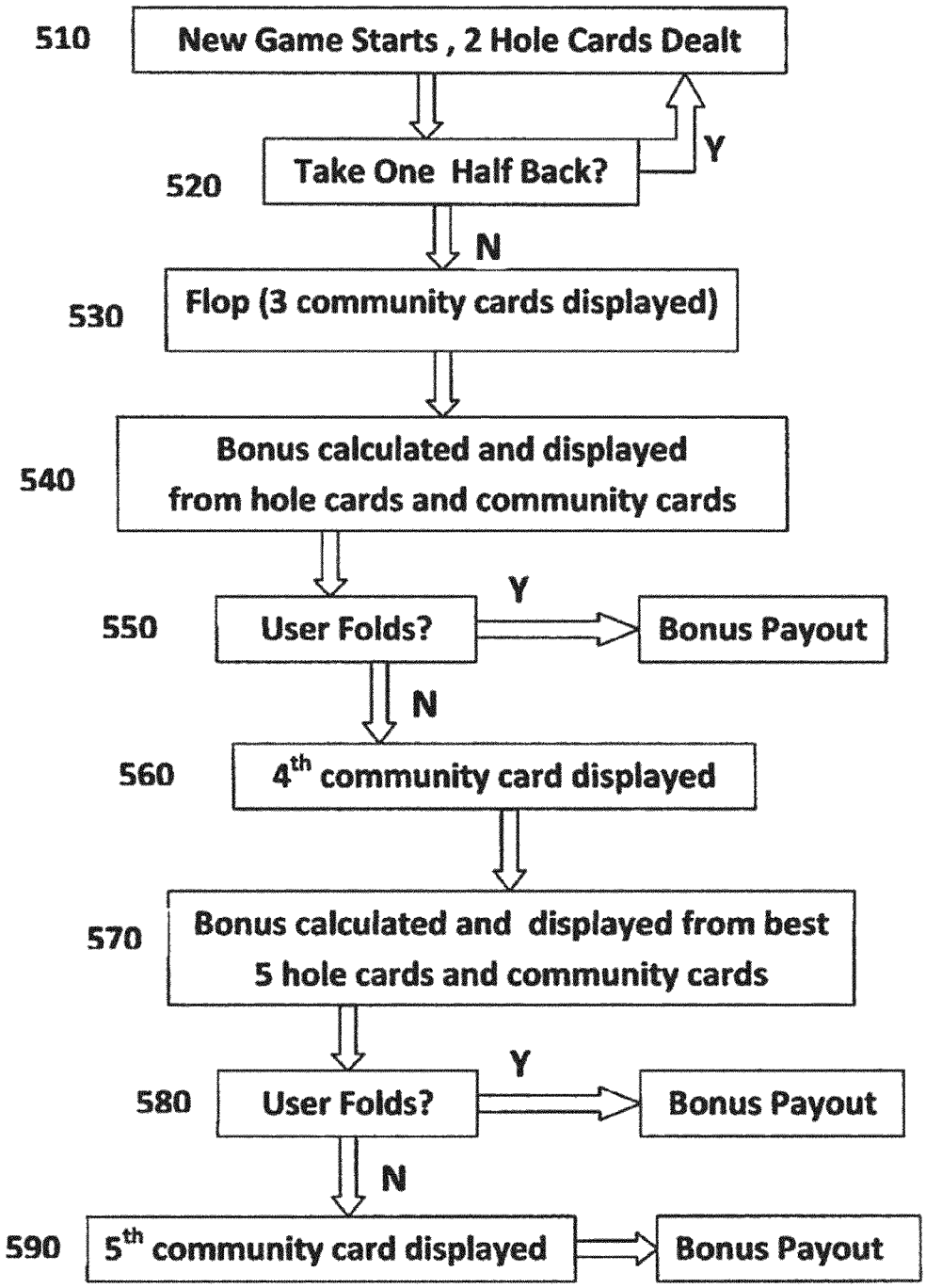
FIG. 5 is a flow chart for a representative bonus scheme according to an embodiment.

In an embodiment shown in FIG. 5, the bonus is calculated for each five card hand of the user and updated as play progresses. A new game begins with two hole cards (510) and the user has the option to surrender (520), which if taken, terminates the game. If not taken, the flop ensues (530) and a possible bonus is calculated and displayed (540). This first bonus possibility can be paid out if the player folds (550) or may be modified after the next community card is drawn (560) as an updated display (570). The user may fold after this update for a bonus payout (580) or play may continue for a last card, after which the user may instantly cash out his bonus (590) without having to wager any more money.

A wide variety of methods are contemplated for calculating the bonus. In an embodiment, the user optionally can select to magnify the bonus by a separate wager, or by linking the bonus to the amount of the ante, and/or by linking the bonus to the amount of the total bet. In an embodiment, the information presented in Table 1 is used to calculate a card strength bonus amount prior to the flop. For example, the amount of bonus would be increased with increased probability of winning, based on the objective statistics presented in this table. This bonus, in another embodiment is paid even if the player elects to receive one half back. Preferably however, the bonus is determined from a five card hand after the flop, and not from a two card hand before the flop.

In an embodiment, the player optionally is allowed to increase his bet for the bonus. This allows the player to hedge his chances against the other virtual players folding when the pot size is small. For example, after the flop, in this embodiment, the player is invited to make a side bet to increase the value of the bonus. For example, in one option his put into the pot could be doubled to double the size of the bonus.

In an embodiment, a display symbol or other visual indicator is presented on the user screen or other readout device, to indicate the status of the bonus feature, if used. For example, a box, button, window, or other image may be displayed. An example of this is the "BONUS PAYOUT TABLE" 360 shown in FIG. 1. Preferably the image(s) or symbol(s) or other visual indicator of the bonus feature is presented at the bottom or side of the playing game as exemplified here. Another embodiment is a stored program that executes a Texas hold'em game with a subroutine that displays a bonus feature and which preferably acts as a "progressive" bonus feature that increases the bonus with increased card chances as community cards are dealt as shown in FIG. 5. Preferably the displayed bonus indication is in or near the game window and more preferably in the upper right hand portion as shown in FIG. 1. Such display provides greater interest and excitement and is particularly preferred.

A light, flashing light, separated image or other symbol also may be used with or even instead of the display mentioned above. A sound such as a buzzer, chime, bell, song, whistle, or any other noise may be used to announce the presence of the bonus feature and/or selection of this feature. For example in an embodiment, the bonus feature is only turned on (display only is made and preferably accompanied by sound) when a threshold value of hole cards is exceeded. For example, the stored program may compare the player's two hole cards with a stored table such as the information of Table 1, and decide on a bonus possibility (and/or amount) based on the percentage chance of a winning hand seen from the table. A stored program that operates a method as described herein may have one or more subroutines and/or outputs for signaling the display signal before a game during a game, and most preferably, after delivery of the hole cards to the player.

End Play, Winning the Pot

Preferably, normal Texas hold'em rules are followed, and a regular round of betting occurs after the turn ($4^{th}$ community card) is displayed and the river ($5^{th}$ community card) is displayed. Most preferably in the game, any time a virtual player folds, the hole cards of that player are revealed to the human player. The pot is awarded to the highest hand remaining in the game at termination. In an embodiment, one or more antes from the virtual players are skipped or decreased in order to provide odds to the house. In another embodiment, the house takes a percentage or fixed amount at each betting stage or at the end of the game during award of the pot.

Virtual Player Personalities

Importantly, in a most preferred embodiment, the virtual players have personalities. Although the embodiments of personalities descried here pertain to Texas hold'em, these embodiments desirably can be used in other poker games as well. For example, creation and use of the personalities described herein are intended for use in regular draw poker games and stud poker games.

For convenience, a "personality" is defined with respect to a standard reference of an objective personality who "plays the cards" according to mathematically predicted outcomes without regard to personality biases. The "standard reference" is a predicable behavior that plays (raises, calls, folds) according to the strength of the cards with respect to possible winning, without regard to other player's behavior. A skilled artisan can find or derive rules for mathematically correct play by the cards, to establish this reference. Mathematically correct calculators are known, as exemplified by http://ezinearticles.com/?Texas-HoldEm-Calculator&id=2967662 the contents of which are specifically incorporated by reference.

Figure 4:
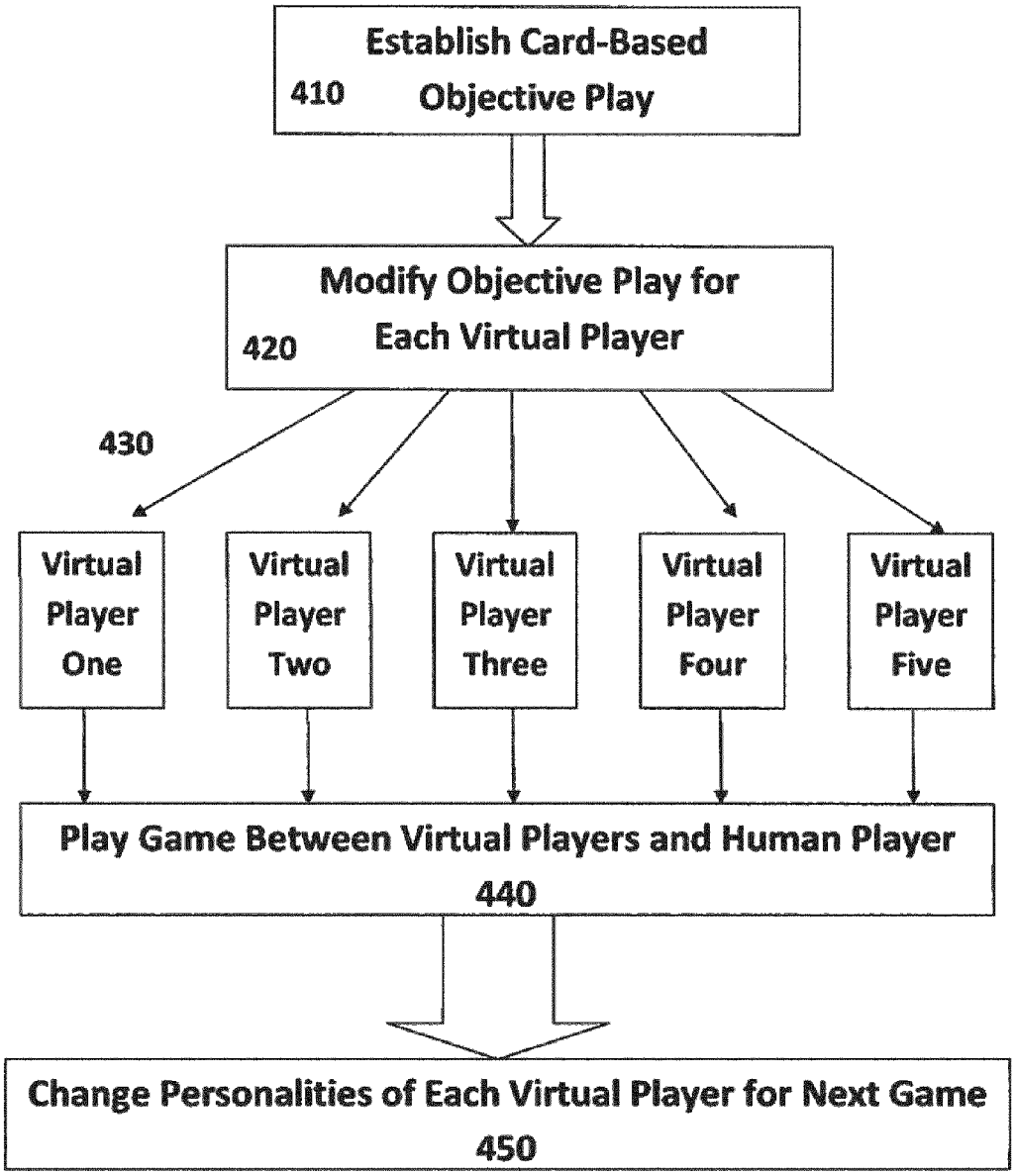
FIG. 4 is a flow chart for a method of preparing and using personalities according to an embodiment.

FIG. 4 shows a preferred method for creation and use of virtual player personalities. An objective, standard 410 (which itself can be a "play the cards, mathematically correct" personality) is generated. In a preferred embodiment, this is a look up table and made or simply accessed from memory by a stored program after hole cards are dealt. The standard look up table preferably is modified after other actions such as folding up of others, revealing of virtual player hole cards of others, and/or betting behavior of others. In a next step 420, personalities are formed by modifying the standard behavior characteristics. The stored program preferably does this two ways. One, the program modifies the lookup table by removing card combinations and/or their probability of success values. Two, the software adjusts one or more coefficients that represent betting behavior. A coefficient typically is used to directly determine whether a virtual player will bid, call, or fold, by a simple comparison of the virtual player's position (card strength) compared to that of others (if no folding or betting has occurred such as before the flop, this is easily done using information in Table 1). A coefficient is compared with a stored value to select which action to take.

In many cases, a personality will be programmed into the software. For example, in an embodiment there are 169 possible hold card possibilities. For each personality, the program determines which hold cards that the particular personality wants to play. For example, Mr. Loose Lou wants to play a lot more hold card hands than Tight Ted (a tight player). The different personalities also have different rankings for the 169 possibilities. For example Solid Sam likes to play suited connectors (an example would be a 10 of clubs and a 9 of clubs). Other players like Mr. Supertight do not like suited connectors. So the 169 hand possibilities are in different orders.

Once the software execution identifies what hands the player wants to play, situations are created on how they will fold. For example if a player has a hold card hand that they really do not want to play, and anyone makes a raise, they fold. Once the program creates such rules for how a virtual player will fold, the program also has rules for when they will call and when they will raise.

A preferred software has Mr. Ace, who likes it when one of his hold cards is an Ace. He will hang on to his hold cards longer AND bet more when one of this hold cards is an ace. Preferred software has some personalities that like to call with almost any two hands (Mr. Telephone.) Once the flop comes out, preferred software has the hand ranking from the best, a royal flush to the worst, not even having a pair.

For each personality, The software may have rules for how a personality will fold, call and raise depending on what hand is held, from Royal flush to nothing.

Just like the hold card round, different virtual players like different hands more than others. They do not all rank them the same way. Thus some will fold on the exact same hand that others will make the call. The software also may have raising situations and going all in situations.

The following is a small exemplary piece of code that directs how one player will play after the flop. If a number is zero, the player will just call, and number of −1 means the player will fold. Any other number is their raise amount. Of course these numbers are different for each player. RF is Royal Flush, the best hand down to 3 to a straight outside, net even having a pair.

|RF|SF|H4K|M4K|4K|FH|FL|ST|H3K|M3K|3K|2P|PP|TP|MP|BP|4F|3F|4SI|3SI|4SO|3SO

Flop No Raise Bet Percentages=100, 100, 100, 100, 100, 75, 100, 100, 50, 50, 50, 40, 25, 40, 30, 20, 30, 0, 40, 0, 0, 0

Turn No Raise Bet Percentages=100, 100, 100, 100, 100, 75, 100, 100, 50, 50, 50, 40, 25, 40, 30, 20, 10, 0, 0, 0, 0, 0

River No Raise Bet Percentages=100

Next are presented examples of basic rules on how players can play different situations. This is just for the flop (the players have played very differently before the flop). Then these situations preferably are modified depending on the player.

The Flop: If the pot has not been raised, then utilize the following rules for each round of betting. If the pot has not been raised with the turn or the river, then preferably use of the same numbers below.

If a virtual player's hold cards are a pair, then bet 25% of the pot. If a virtual player gets bottom pair with the flop, or gets the lowest pair possible with the turn or the river, bet 20% of the pot. If a virtual player gets middle pair with the flop, or gets a pair that is not the lowest possible pair but not the highest pair possible, with the turn or the river, bet 30% of the pot. If a virtual player gets top pair with the flop or gets the top pair possible with the turn or the river, bet 40% of the pot. If a virtual player gets two pair with the flop, or has two pair with the turn or the river bet 40% of the pot. If a virtual player gets three of a kind with the flop or with the turn or the river bet 50% of the pot. If a virtual payer gets a full house with the flop or with the turn or the river bet 75% of the pot. If a virtual player gets 4 of a kind or better with the flop, turn or river bet 100% of the pot. If a virtual player gets 4 to a flush the on the flop or turn, bet 30% of the pot. If a virtual player gets 4 to a straight and they are 4 cards together (4,5,6,7) on the flop or turn bet 40% of the pot. If a virtual player gets a straight on the flop or turn or river bet 100% of the pot. If a virtual player gets a flush on the flop, turn or river bet 100% of the pot.

A second possibility for the flop is to execute the above, and the live person raises the virtual player's raise. The following then is then used for all virtual players in a preferred embodiment:

If the flop misses the virtual player's hand and the virtual player lacks a pocket pair, then if the live person raises the pot any amount, fold. If the flop misses our hand and the virtual player do have a pocket pair, and the pot is raised more than 50%, if our pocket pair has a rank if 12 or less (12=a pair of queens) the virtual player folds. If any virtual player has bottom pair and the live person re raises the pot 25% or more, and the virtual player has a pair of tens or less (10 points) fold. If a virtual player has middle pair and the live person re-raises the pot 25% or more and the virtual player have ten points or less (a pair of 10's or lower) the virtual player fold. If any virtual player has top pair and the live person re raised the pot 30% and the virtual player has 10 points or less (a pair of tens or lower) we fold. If a virtual player has two pair and the pot is re raised any amount the virtual player will fold with 19 points or less (a pair of kings is 13 points and a pair of 9's is 9 points so that equals 19 points, so the virtual player would fold). If a virtual player has 3 to a flush OR three to a straight the virtual player will call any raise of under 25%. If the pot is raised more than 25% the virtual player will fold. If any virtual player has a belly buster straight and the pot is raised less than 20% the virtual player will call. if the pot is raised more than 20% the virtual player will fold. If any virtual player has 4 to a straight OR 4 to a flush the virtual player will call all raises to the pot of less than 75%. If the pot is raised more than 75% the virtual player will fold.

A third possibility with the flop is that the pot has been raised by the live player before the virtual player's turn to act. (continuing the logic that one virtual player will not raise a raise of another virtual player). If any virtual player does not have a pocket pair and the flop misses our hand, and the pot has been raised by the live person any amount, fold. If any virtual player has bottom pair and the bottom pair has a rank of 10 or lower the virtual player will fold with any raise. If any virtual player has middle pair and the middle pair has a rank of 10 or lower the virtual player will fold with any raise. If any virtual player has top pair and the top pair has a rank of 10 or lower the virtual player will fold with any raise. If any virtual player has two pair and the total of the two pair is 19 points or less, the virtual player will fold with any raise. If any virtual player has 3 to a flush OR three to a straight, the virtual player will fold with a raise to the pot of more than 50%. If any virtual player has a belly buster straight an the pot is raised 30% or more the virtual player will fold. If any virtual player has 4 to a straight OR 4 to a flush the virtual player and the pot is raised more than 75% the virtual player will fold.

These embodiments are representative only and the software code used is generic. The software coefficients can be changed. For example, in situation #3 above, none of what is listed is correct for Mrs. Loose Lou. Her folding, checking and raising numbers are all different. Each specific combination/action listed is a useful embodiment and by itself may be combined with another condition recited herein, such as folding up of virtual players, in a useful stored program driven game.

Other Personality Examples

Many such personalities can be crafted and are contemplated as embodiments One personality is this reference type that "plays the cards" at least most of the time and can be termed a "standard reference." By "most of the time" is meant that the decision to call, raise, bet or fold follows the mathematical ideal at least 75% of the time and preferably 90% of the time. A skilled artisan can pick a mathematical based lookup table or algorithm for this.

Other personalities depart from the standard reference by at least one of the following parameters: 1) reordering of hand rankings; 2) propensity to fold; 3) propensity to call; 4) propensity to raise; 5) propensity to bluff. In practice, a human player usually can easily sense a "personality" that departs from the standard reference by playing one or more games with the player. For the sake of arithmetic convenience, a "personality" as termed herein can be defined as a player with behavior that departs at least 15% from the standard reference with respect to one or more of the parameters. In another embodiment, a personality is defined as a player with behavior that departs at least 25% and even more preferably at least 50% from the standard reference. These parameters are presented as a guideline for convenience and a skilled artisan can derive more parameters, based on the information herein. All such parameters are included in embodiments.

Reordering of Hand Rankings

A player that plays his cards according to a ranking system that differs from the standard poker ranking has this personality. For example, some players when faced with the possible hole card combinations of Table 1, do not rank their probabilities the same way but follow a different decision at least 15%, more preferably at least 25% and yet more preferably at least 50% of the time. Some players emphasize suited connectors and treat hole cards of the same suit as higher ranking when betting. Others may disfavor suited connectors and treat hole cards of the same suit as lower rank for betting at least 15%, more preferably at least 25% and yet more preferably at least 50% of the time. If such reordering results in different betting (raising when a standard player would not or folding when a standard player would not, for example) at least 25% of the time based on the different reordering, then that player has the reordering personality characteristic.

This characteristic can be implemented in a stored program various ways. One way is to start with (load or generate) an objective probability table such as shown in Table 1 to make a standard personality, and then make changes such as arbitrarily or thematically change probability levels that are used for betting. For example, a personality that likes Aces can be generated by elevating the probability of winning pot for hole cards that are Aces. The elevation can be done by recalculating a higher value or by simply advancing (moving up) the position of card combinations that include at least one Ace so that a player will more likely stay in the game and bet based on the presence of one or more Aces as hole cards. A stored program that generates such personality by these steps is contemplated.

Propensity to Fold

A player with this personality will fold at least 15%, more preferably at least 25% and yet more preferably at least 50% more often compared to a standard player with the same cards. This personality trait, as well as the others, generally will manifest itself differently from before the flop to after the flop, and through the following steps, depending on the behavior of other players. A stored program that implements this personality preferably has a coefficient for folding that is compared with the strength of the hole cards. If the coefficient for folding, which is a threshold value for folding, is higher than the value coefficient of hole cards (which is positively associated with strength of the hole cards) then the virtual player will fold. To make a "folding" personality, this coefficient is merely set higher. The stored program preferably has a stored coefficient that is calculated to give a higher probability of folding, preferably at least 15% higher, 25% higher and even more preferably at least 50% higher, as compared with the probability of folding for all hands.

Propensity to Call

A player with this personality will call at least 15%, more preferably at least 25% and yet more preferably at least 50% more often compared to a standard personality player with the same cards. This personality trait, as well as the others, generally will manifest itself differently from before the flop to afterwards, and through the following steps, depending on the behavior of other players. As described above for folding, the chances of calling preferably is altered, to make this personality by a software that compares a value of hole cards and preferably other factors, such as whether another player has raised or called, to output a decision to call. A higher stored coefficient for calling can be used to increase chances that the player will call.

Propensity to Raise

A player with this personality will raise at least 15%, more preferably at least 25% and yet more preferably at least 50% more often compared to a standard player with the same cards. This personality trait, as well as the others, generally will manifest itself differently from before the flop to afterwards, and through the following steps, depending on the behavior of other players.

A stored program that implements this personality preferably has a coefficient for raising that is compared with the strength of the hole cards. If the coefficient for raising, which is a threshold value for raising, is lower than the value coefficient of hole cards (which is positively associated with strength of the hole cards) then the virtual player will raise. To make a "risky" personality with respect to raising, this coefficient is merely set higher. The stored program preferably has a stored coefficient that is calculated to give a higher probability of raising, preferably at least 15% higher, 25% higher and even more preferably at least 50% higher, as measured by the probability of raising for all probability of hands. Other factors preferably are used to calculate this coefficient, such as whether another player has raised and by how much relative to the pot. If another player has raised, then the coefficient is increased. If the other raise was large, then the coefficient is increased even more.

Propensity to Bluff

A player with this personality will bluff at least 15%, more preferably at least 25% and yet more preferably at least 50% more often compared to a standard player with the same cards. This personality trait, as well as the others, generally will manifest itself differently from before the flop to afterwards, and through the following steps, depending on the behavior of other players.

Rotate Personalities

In an embodiment, player excitement is enhanced by changing the virtual player personalities. Preferably at least 3, more preferably at least 5 and yet more preferably at least 8 personalities are used. Preferably the personalities are changed for each player position at least every 3 games and more preferably after (or even during) every game. In a preferred embodiment, at least 8 personalities are stored as parameters within a program and used with 5 virtual players. After each hand, the personalities are changed so that the two-dimensional identification of virtual players as images of hole cards, as represented for example in FIG. 1, do not keep the same personalities between games. In an embodiment, however, the same personalities are kept for two games, three games, four games, five games or even more before being changed. This adds excitement for the user, who can look forward to discovery of specific personalities through play. In an embodiment, the frequency of change and even the type of personality of virtual player may be chosen by the human player.

Every reference cited that has one or more method or method steps applicable to Texas hold'em is specifically incorporated by reference especially for that method or method step. Every reference cited that has a device, apparatus, material or teaching useful for implementing a stored program or subroutine on a user computer, slot machine, internet based, multiple computer shared based or other hardware, is specifically incorporated by reference for that specific apparatus, material or teaching. The appended claims are not limited to embodiments enumerated herein but are interpreted by a skilled artisan, who is someone with at least 3 years of experience in the gaming industry.

TABLE 1

| | Number of Opponents | | | | | | | | |
|---|---|---|---|---|---|---|---|---|---|
| Cards | 1 | 2 | 3 | 4 | 5 | 6 | 7 | 8 | 9 |
| AA | 85.3 | 73.4 | 63.9 | 55.9 | 49.2 | 43.6 | 38.8 | 34.7 | 31.1 |
| Aks | 67.0 | 50.7 | 41.4 | 35.4 | 31.1 | 27.7 | 25.0 | 22.7 | 20.7 |
| AK | 65.4 | 48.2 | 38.6 | 32.4 | 27.9 | 24.4 | 21.6 | 19.2 | 17.2 |
| AQs | 66.1 | 49.4 | 39.9 | 33.7 | 29.4 | 26.0 | 23.3 | 21.1 | 19.3 |
| AQ | 64.5 | 46.8 | 36.9 | 30.4 | 25.9 | 22.5 | 19.7 | 17.5 | 15.5 |
| AJs | 65.4 | 48.2 | 38.5 | 32.2 | 27.8 | 24.5 | 22.0 | 19.9 | 18.1 |
| AJ | 63.6 | 45.6 | 35.4 | 28.9 | 24.4 | 21.0 | 18.3 | 16.1 | 14.3 |
| ATs | 64.7 | 47.1 | 37.2 | 31.0 | 26.7 | 23.5 | 21.0 | 18.9 | 17.3 |
| AT | 62.9 | 44.4 | 34.1 | 27.6 | 23.1 | 19.8 | 17.2 | 15.1 | 13.4 |
| A9s | 63.0 | 44.8 | 34.6 | 28.4 | 24.2 | 21.1 | 18.8 | 16.9 | 15.4 |
| A9 | 60.9 | 41.8 | 31.2 | 24.7 | 20.3 | 17.1 | 14.7 | 12.8 | 11.2 |
| A8s | 62.1 | 43.7 | 33.6 | 27.4 | 23.3 | 20.3 | 18.0 | 16.2 | 14.8 |
| A8 | 60.1 | 40.8 | 30.1 | 23.7 | 19.4 | 16.2 | 13.9 | 12.0 | 10.6 |
| A7s | 61.1 | 42.6 | 32.6 | 26.5 | 22.5 | 19.6 | 17.4 | 15.7 | 14.3 |
| A7 | 59.1 | 39.4 | 28.9 | 22.6 | 18.4 | 15.4 | 13.2 | 11.4 | 10.1 |
| A6s | 60.0 | 41.3 | 31.4 | 25.6 | 21.7 | 19.0 | 16.9 | 15.3 | 14.0 |
| A6 | 57.8 | 38.0 | 27.6 | 21.5 | 17.5 | 14.7 | 12.6 | 10.9 | 9.6 |
| A5s | 59.9 | 41.4 | 31.8 | 26.0 | 22.2 | 19.6 | 17.5 | 15.9 | 14.5 |
| A5 | 57.7 | 38.2 | 27.9 | 22.0 | 18.0 | 15.2 | 13.1 | 11.5 | 10.1 |
| A4s | 58.9 | 40.4 | 30.9 | 25.3 | 21.6 | 19.0 | 17.0 | 15.5 | 14.2 |
| A4 | 56.4 | 36.9 | 26.9 | 21.1 | 17.3 | 14.7 | 12.6 | 11.0 | 9.8 |

TABLE 1-continued

| Cards | Number of Opponents 1 | 2 | 3 | 4 | 5 | 6 | 7 | 8 | 9 |
|---|---|---|---|---|---|---|---|---|---|
| A3s | 58.0 | 39.4 | 30.0 | 24.6 | 21.0 | 18.5 | 16.6 | 15.1 | 13.9 |
| A3 | 55.6 | 35.9 | 26.1 | 20.4 | 16.7 | 14.2 | 12.2 | 10.7 | 9.5 |
| A2s | 57.0 | 38.5 | 29.2 | 23.9 | 20.4 | 18.0 | 16.1 | 14.6 | 13.4 |
| A2 | 54.6 | 35.0 | 25.2 | 19.6 | 16.1 | 13.6 | 11.7 | 10.2 | 9.1 |
| KK | 82.4 | 68.9 | 58.2 | 49.8 | 43.0 | 37.5 | 32.9 | 29.2 | 26.1 |
| KQs | 63.4 | 47.1 | 38.2 | 32.5 | 28.3 | 25.1 | 22.5 | 20.4 | 18.6 |
| KQ | 61.4 | 44.4 | 35.2 | 29.3 | 25.1 | 21.8 | 19.1 | 16.9 | 15.1 |
| KJs | 62.6 | 45.9 | 36.8 | 31.1 | 26.9 | 23.8 | 21.3 | 19.3 | 17.6 |
| KJ | 60.6 | 43.1 | 33.6 | 27.6 | 23.5 | 20.2 | 17.7 | 15.6 | 13.9 |
| KTs | 61.9 | 44.9 | 35.7 | 29.9 | 25.8 | 22.8 | 20.4 | 18.5 | 16.9 |
| KT | 59.9 | 42.0 | 32.5 | 26.5 | 22.3 | 19.2 | 16.7 | 14.7 | 13.1 |
| K9s | 60.0 | 42.4 | 32.9 | 27.2 | 23.2 | 20.3 | 18.1 | 16.3 | 14.8 |
| K9 | 58.0 | 39.5 | 29.6 | 23.6 | 19.5 | 16.5 | 14.1 | 12.3 | 10.8 |
| K8s | 58.5 | 40.2 | 30.8 | 25.1 | 21.3 | 18.6 | 16.5 | 14.8 | 13.5 |
| K8 | 56.3 | 37.2 | 27.3 | 21.4 | 17.4 | 14.6 | 12.5 | 10.8 | 9.4 |
| K7s | 57.8 | 39.4 | 30.1 | 24.5 | 20.8 | 18.1 | 16.0 | 14.5 | 13.2 |
| K7 | 55.4 | 36.1 | 26.3 | 20.5 | 16.7 | 13.9 | 11.8 | 10.2 | 9.0 |
| K6s | 56.8 | 38.4 | 29.1 | 23.7 | 20.1 | 17.5 | 15.6 | 14.0 | 12.8 |
| K6 | 54.3 | 35.0 | 25.3 | 19.7 | 16.0 | 13.3 | 11.3 | 9.8 | 8.6 |
| K5s | 55.8 | 37.4 | 28.2 | 23.0 | 19.5 | 17.0 | 15.2 | 13.7 | 12.5 |
| K5 | 53.3 | 34.0 | 24.5 | 19.0 | 15.4 | 12.9 | 11.0 | 9.5 | 8.3 |
| K4s | 54.7 | 36.4 | 27.4 | 22.3 | 19.0 | 16.6 | 14.8 | 13.4 | 12.3 |
| K4 | 52.1 | 32.8 | 23.4 | 18.1 | 14.7 | 12.3 | 10.5 | 9.1 | 8.0 |
| K3s | 53.8 | 35.5 | 26.7 | 21.7 | 18.4 | 16.2 | 14.5 | 13.1 | 12.1 |
| K3 | 51.2 | 31.9 | 22.7 | 17.6 | 14.2 | 11.9 | 10.2 | 8.9 | 7.8 |
| K2s | 52.9 | 34.6 | 26.0 | 21.2 | 18.1 | 15.9 | 14.3 | 13.0 | 11.9 |
| K2 | 50.2 | 30.9 | 21.8 | 16.9 | 13.7 | 11.5 | 9.8 | 8.6 | 7.6 |
| QQ | 79.9 | 64.9 | 53.5 | 44.7 | 37.9 | 32.5 | 28.3 | 24.9 | 22.2 |
| QJs | 60.3 | 44.1 | 35.6 | 30.1 | 26.1 | 23.0 | 20.7 | 18.7 | 17.1 |
| QJ | 58.2 | 41.4 | 32.6 | 26.9 | 22.9 | 19.8 | 17.3 | 15.9 | 13.7 |
| QTs | 59.5 | 43.1 | 34.6 | 29.1 | 25.2 | 22.3 | 19.9 | 18.1 | 16.6 |
| QT | 57.4 | 40.2 | 31.3 | 25.7 | 21.6 | 18.6 | 16.3 | 14.4 | 12.9 |
| Q9s | 57.9 | 40.7 | 31.9 | 26.4 | 22.5 | 19.7 | 17.6 | 15.9 | 14.5 |
| Q9 | 55.5 | 37.6 | 28.5 | 22.9 | 19.0 | 16.1 | 13.8 | 12.1 | 10.7 |
| Q8s | 56.2 | 38.6 | 29.7 | 24.4 | 20.7 | 18.0 | 16.0 | 14.4 | 13.2 |
| Q8 | 53.8 | 35.4 | 26.2 | 20.5 | 16.9 | 14.1 | 12.1 | 10.5 | 9.2 |
| Q7s | 54.5 | 36.7 | 27.9 | 22.7 | 19.2 | 16.7 | 14.8 | 13.3 | 12.1 |
| Q7 | 51.9 | 33.2 | 24.0 | 18.6 | 15.1 | 12.5 | 10.6 | 9.2 | 8.0 |
| Q6s | 53.8 | 35.8 | 27.1 | 21.9 | 18.5 | 16.1 | 14.3 | 12.9 | 11.7 |
| Q6 | 51.1 | 32.3 | 23.2 | 17.9 | 14.4 | 12.0 | 10.1 | 8.8 | 7.6 |
| Q5s | 52.9 | 34.9 | 26.3 | 21.4 | 18.1 | 15.8 | 14.1 | 12.7 | 11.6 |
| Q5 | 50.2 | 31.3 | 22.3 | 17.3 | 13.9 | 11.6 | 9.8 | 8.5 | 7.4 |
| Q4s | 51.7 | 33.9 | 25.5 | 20.7 | 17.6 | 15.4 | 13.7 | 12.4 | 11.3 |
| Q4 | 49.0 | 30.2 | 21.4 | 16.4 | 13.3 | 11.0 | 9.4 | 8.1 | 7.1 |
| Q3s | 50.7 | 33.0 | 24.7 | 20.1 | 17.0 | 14.9 | 13.3 | 12.1 | 11.1 |
| Q3 | 47.9 | 29.2 | 20.7 | 15.9 | 12.8 | 10.7 | 9.1 | 7.9 | 6.9 |
| Q2s | 49.9 | 32.2 | 24.0 | 19.5 | 16.6 | 14.6 | 13.1 | 11.9 | 10.9 |
| Q2 | 47.0 | 28.4 | 19.9 | 15.3 | 12.3 | 10.3 | 8.8 | 7.7 | 6.8 |
| JJ | 77.5 | 61.2 | 49.2 | 40.3 | 33.6 | 28.5 | 24.6 | 21.6 | 19.3 |
| JTs | 57.5 | 41.9 | 33.8 | 28.5 | 24.7 | 21.9 | 19.7 | 17.9 | 16.5 |
| JT | 55.4 | 39.0 | 30.7 | 25.3 | 21.5 | 18.6 | 16.3 | 14.5 | 13.1 |
| J9s | 55.8 | 39.6 | 31.3 | 26.1 | 22.4 | 19.7 | 17.6 | 15.9 | 14.6 |
| J9 | 53.4 | 36.5 | 27.9 | 22.5 | 18.7 | 15.9 | 13.8 | 12.1 | 10.8 |
| J8s | 54.2 | 37.5 | 29.1 | 24.0 | 20.5 | 17.9 | 15.9 | 14.4 | 13.2 |
| J8 | 51.7 | 34.2 | 25.6 | 20.4 | 16.8 | 14.1 | 12.2 | 10.7 | 9.5 |
| J7s | 52.4 | 35.4 | 27.1 | 22.2 | 18.9 | 16.4 | 14.6 | 13.2 | 12.0 |
| J7 | 49.9 | 32.1 | 23.5 | 18.3 | 14.9 | 12.4 | 10.6 | 9.2 | 8.1 |
| J6s | 50.8 | 33.6 | 25.4 | 20.6 | 17.4 | 15.2 | 13.5 | 12.1 | 11.1 |
| J6 | 47.9 | 29.8 | 21.4 | 16.5 | 13.2 | 11.0 | 9.3 | 8.0 | 7.0 |
| J5s | 50.0 | 32.8 | 24.7 | 20.0 | 17.0 | 14.7 | 13.1 | 11.8 | 10.8 |
| J5 | 47.1 | 29.1 | 20.7 | 15.9 | 12.8 | 10.6 | 8.9 | 7.7 | 6.7 |
| J4s | 49.0 | 31.8 | 24.0 | 19.4 | 16.4 | 14.3 | 12.8 | 11.5 | 10.6 |
| J4 | 46.1 | 28.1 | 19.9 | 15.3 | 12.3 | 10.2 | 8.6 | 7.5 | 6.5 |
| J3s | 47.9 | 30.9 | 23.2 | 18.8 | 16.0 | 14.0 | 12.5 | 11.3 | 10.4 |
| J3 | 45.0 | 27.1 | 19.1 | 14.6 | 11.7 | 9.8 | 8.3 | 7.2 | 5.3 |
| J2s | 47.1 | 30.1 | 22.6 | 18.3 | 15.6 | 13.7 | 12.2 | 11.1 | 10.2 |
| J2 | 44.0 | 26.2 | 18.4 | 14.1 | 11.3 | 9.4 | 8.0 | 7.0 | 6.2 |
| TT | 75.1 | 57.7 | 45.2 | 36.4 | 30.8 | 25.3 | 21.8 | 19.2 | 17.2 |
| T9s | 54.3 | 38.9 | 31.0 | 26.0 | 22.5 | 19.8 | 17.8 | 16.2 | 14.9 |
| T9 | 51.7 | 35.7 | 27.7 | 22.5 | 18.9 | 15.2 | 14.1 | 12.6 | 11.3 |
| T8s | 52.6 | 36.9 | 29.0 | 24.0 | 20.6 | 18.1 | 16.2 | 14.8 | 13.6 |
| T8 | 50.0 | 33.6 | 25.4 | 20.4 | 16.9 | 14.4 | 12.5 | 11.0 | 9.9 |
| T7s | 51.0 | 34.9 | 27.0 | 22.2 | 19.0 | 16.6 | 14.6 | 13.5 | 12.4 |
| T7 | 48.2 | 31.4 | 23.4 | 18.4 | 15.1 | 12.8 | 11.0 | 9.7 | 8.6 |
| T6s | 49.2 | 32.8 | 25.1 | 20.5 | 17.4 | 15.2 | 13.6 | 12.3 | 11.2 |
| T6 | 46.3 | 29.2 | 21.2 | 16.5 | 13.4 | 11.2 | 9.5 | 8.3 | 7.3 |

TABLE 1-continued

| Cards | Number of Opponents 1 | 2 | 3 | 4 | 5 | 6 | 7 | 8 | 9 |
|---|---|---|---|---|---|---|---|---|---|
| T5s | 47.2 | 30.8 | 23.3 | 18.9 | 16.0 | 13.9 | 12.4 | 11.2 | 10.2 |
| T5 | 44.2 | 27.1 | 19.3 | 14.8 | 11.9 | 9.9 | 8.4 | 7.2 | 6.4 |
| T4s | 46.4 | 30.1 | 22.7 | 18.4 | 15.6 | 13.6 | 12.1 | 11.0 | 10.0 |
| T4 | 43.4 | 26.4 | 18.7 | 14.3 | 11.5 | 9.5 | 8.1 | 7.0 | 6.2 |
| T3s | 45.5 | 29.3 | 22.0 | 17.8 | 15.1 | 13.2 | 11.8 | 10.7 | 9.8 |
| T3 | 42.4 | 25.5 | 18.0 | 13.7 | 11.0 | 9.1 | 7.8 | 6.8 | 6.0 |
| T2s | 44.7 | 28.5 | 21.4 | 17.4 | 14.8 | 13.0 | 11.6 | 10.5 | 9.7 |
| T2 | 41.5 | 24.7 | 17.3 | 13.2 | 10.6 | 8.8 | 7.5 | 6.6 | 5.8 |
| 99 | 72.1 | 53.5 | 41.1 | 32.6 | 26.6 | 22.4 | 19.4 | 17.2 | 15.6 |
| 98s | 51.1 | 36.0 | 28.5 | 23.6 | 20.2 | 17.8 | 15.9 | 14.5 | 13.4 |
| 98 | 48.4 | 32.9 | 25.1 | 20.1 | 16.6 | 14.2 | 12.3 | 10.9 | 9.9 |
| 97s | 49.5 | 34.2 | 26.8 | 22.1 | 18.9 | 16.6 | 14.9 | 13.6 | 12.5 |
| 97 | 46.7 | 30.9 | 23.1 | 18.4 | 15.1 | 12.8 | 11.1 | 9.8 | 8.8 |
| 96s | 47.7 | 32.3 | 24.9 | 20.4 | 17.4 | 15.3 | 13.7 | 12.4 | 11.4 |
| 96 | 44.9 | 28.8 | 21.2 | 16.6 | 13.5 | 11.4 | 9.8 | 8.7 | 7.8 |
| 95s | 45.9 | 30.4 | 23.2 | 18.8 | 16.0 | 13.9 | 12.4 | 11.3 | 10.3 |
| 95 | 42.9 | 26.7 | 19.2 | 14.8 | 12.0 | 10.0 | 8.5 | 7.4 | 6.6 |
| 94s | 43.8 | 28.4 | 21.3 | 17.3 | 14.6 | 12.7 | 11.3 | 10.3 | 9.4 |
| 94 | 40.7 | 24.6 | 17.3 | 13.2 | 10.5 | 8.7 | 7.3 | 6.4 | 5.6 |
| 93s | 43.2 | 27.8 | 20.8 | 16.8 | 14.3 | 12.5 | 11.1 | 10.1 | 9.2 |
| 93 | 39.9 | 23.9 | 16.7 | 12.7 | 10.1 | 8.3 | 7.1 | 6.1 | 5.4 |
| 92s | 42.3 | 27.0 | 20.2 | 16.4 | 13.9 | 12.2 | 10.9 | 9.9 | 9.1 |
| 92 | 38.9 | 22.9 | 16.0 | 12.1 | 9.6 | 8.0 | 6.8 | 5.9 | 5.2 |
| 88 | 69.1 | 49.9 | 37.5 | 29.4 | 24.0 | 20.3 | 17.7 | 15.8 | 14.4 |
| 87s | 48.2 | 33.9 | 26.6 | 22.0 | 18.9 | 16.7 | 15.0 | 13.7 | 12.7 |
| 87 | 45.5 | 30.6 | 23.2 | 18.5 | 15.4 | 13.1 | 11.5 | 10.3 | 9.3 |
| 86s | 46.5 | 32.0 | 25.0 | 20.6 | 17.6 | 15.6 | 14.1 | 12.9 | 11.9 |
| 86 | 43.6 | 28.6 | 21.3 | 16.9 | 13.9 | 11.8 | 10.4 | 9.2 | 8.3 |
| 85s | 44.8 | 30.2 | 23.2 | 19.1 | 16.3 | 14.3 | 12.9 | 11.8 | 10.9 |
| 85 | 41.7 | 26.5 | 19.4 | 15.2 | 12.4 | 10.5 | 9.1 | 8.1 | 7.3 |
| 84s | 42.7 | 28.1 | 21.4 | 17.4 | 14.8 | 13.0 | 11.7 | 10.6 | 9.8 |
| 84 | 39.6 | 24.4 | 17.5 | 13.4 | 10.8 | 9.0 | 7.8 | 6.8 | 6.1 |
| 83s | 40.8 | 26.3 | 19.8 | 16.0 | 13.6 | 11.9 | 10.7 | 9.7 | 8.9 |
| 83 | 37.5 | 22.4 | 15.7 | 11.9 | 9.5 | 7.9 | 6.7 | 5.8 | 5.1 |
| 82s | 40.3 | 25.8 | 19.4 | 15.7 | 13.3 | 11.7 | 10.5 | 9.6 | 8.8 |
| 82 | 36.8 | 21.7 | 15.1 | 11.4 | 9.1 | 7.5 | 6.4 | 5.6 | 4.9 |
| 77 | 66.2 | 46.4 | 34.4 | 26.8 | 21.9 | 18.6 | 16.4 | 14.8 | 13.7 |
| 76s | 45.7 | 32.0 | 25.1 | 20.8 | 18.0 | 15.9 | 14.4 | 13.2 | 12.3 |
| 76 | 42.7 | 28.5 | 21.5 | 17.1 | 14.2 | 12.2 | 10.8 | 9.6 | 8.8 |
| 75s | 43.8 | 30.1 | 23.4 | 19.4 | 16.7 | 14.8 | 13.4 | 12.3 | 11.4 |
| 75 | 40.8 | 26.5 | 19.7 | 15.5 | 12.8 | 11.0 | 9.7 | 8.7 | 7.9 |
| 74s | 41.8 | 28.2 | 21.7 | 17.9 | 15.3 | 13.5 | 12.2 | 11.2 | 10.4 |
| 74 | 38.6 | 24.5 | 17.9 | 13.9 | 11.4 | 9.7 | 8.5 | 7.6 | 6.8 |
| 73s | 40.0 | 26.3 | 20.0 | 16.4 | 14.0 | 12.3 | 11.1 | 10.1 | 9.3 |
| 73 | 36.6 | 22.4 | 16.0 | 12.3 | 9.9 | 8.4 | 7.2 | 6.4 | 5.7 |
| 72s | 38.1 | 24.5 | 18.4 | 15.0 | 12.8 | 11.2 | 10.1 | 9.2 | 8.5 |
| 72 | 34.6 | 20.4 | 14.2 | 10.7 | 8.6 | 7.2 | 6.1 | 5.4 | 4.8 |
| 66 | 63.3 | 43.2 | 31.5 | 24.5 | 20.1 | 17.3 | 15.4 | 14.0 | 13.1 |
| 65s | 43.2 | 30.2 | 23.7 | 19.7 | 17.0 | 15.2 | 13.8 | 12.7 | 11.9 |
| 65 | 40.1 | 26.7 | 20.0 | 15.9 | 13.3 | 11.5 | 10.2 | 9.2 | 8.5 |
| 64s | 41.4 | 28.5 | 22.1 | 18.4 | 15.9 | 14.2 | 12.9 | 11.9 | 11.1 |
| 64 | 38.0 | 24.7 | 18.2 | 14.4 | 12.0 | 10.3 | 9.2 | 8.3 | 7.6 |
| 63s | 39.4 | 26.5 | 20.4 | 16.8 | 14.5 | 12.9 | 11.7 | 10.8 | 10.0 |
| 63 | 35.9 | 22.7 | 16.4 | 12.8 | 10.6 | 9.1 | 8.0 | 7.2 | 6.5 |
| 62s | 37.5 | 24.8 | 18.8 | 15.4 | 13.3 | 11.8 | 10.7 | 9.8 | 9.1 |
| 62 | 34.0 | 20.7 | 14.6 | 11.2 | 9.1 | 7.8 | 6.8 | 6.0 | 5.4 |
| 55 | 60.3 | 40.1 | 28.8 | 22.4 | 18.5 | 16.0 | 14.4 | 13.2 | 12.3 |
| 54s | 41.1 | 28.8 | 22.6 | 18.9 | 16.5 | 14.8 | 13.5 | 12.5 | 11.7 |
| 54 | 37.9 | 25.2 | 18.8 | 15.0 | 12.6 | 11.0 | 9.8 | 8.9 | 8.2 |
| 53s | 39.3 | 27.1 | 21.1 | 17.5 | 15.2 | 13.7 | 12.5 | 11.6 | 10.8 |
| 53 | 35.8 | 23.3 | 17.1 | 13.6 | 11.4 | 9.9 | 8.8 | 8.0 | 7.3 |
| 52s | 37.5 | 25.3 | 19.5 | 16.1 | 14.0 | 12.5 | 11.4 | 10.6 | 9.8 |
| 52 | 33.9 | 21.3 | 15.3 | 12.0 | 10.0 | 8.6 | 7.6 | 6.8 | 6.2 |
| 44 | 57.0 | 36.8 | 26.3 | 20.6 | 17.3 | 15.2 | 13.9 | 12.9 | 12.1 |
| 43s | 38.0 | 26.2 | 20.3 | 16.9 | 14.7 | 13.1 | 12.0 | 11.1 | 10.3 |
| 43 | 34.4 | 22.3 | 16.3 | 12.8 | 10.7 | 9.3 | 8.3 | 7.5 | 6.8 |
| 42s | 36.3 | 24.6 | 18.8 | 15.7 | 13.7 | 12.3 | 11.2 | 10.4 | 9.6 |
| 42 | 32.5 | 20.5 | 14.7 | 11.5 | 9.5 | 8.3 | 7.3 | 6.6 | 6.0 |
| 33 | 53.7 | 33.5 | 23.9 | 19.0 | 16.2 | 14.6 | 13.5 | 12.6 | 12.0 |
| 32s | 35.1 | 23.6 | 18.0 | 14.9 | 13.0 | 11.7 | 10.7 | 9.9 | 9.2 |
| 32 | 31.2 | 19.5 | 13.9 | 10.8 | 8.9 | 7.7 | 6.8 | 6.1 | 5.6 |
| 22 | 50.3 | 30.7 | 22.0 | 17.8 | 15.5 | 14.2 | 13.3 | 12.5 | 12.0 |

I claim:

1. A computer implemented Texas hold'em card game having virtual players and at least one human player, the computer comprising a visual display device and a processor operably coupled to the display device and combined to display a card game, the processor programmed for a method comprising the steps of a Texas hold'em game, wherein the at least one human player folds down and the virtual players fold up such that the folded up cards are shown to the at least one human player during play, further comprising a bonus feature that awards the human player but not the virtual players a bonus based on the best 5 card combination of the human player's hand and awarded without regard to winning the game.

2. A computer implemented Texas hold'em card game having virtual players and one human player, the computer comprising a visual display device and a processor operably coupled to the display device and combined to display a card game, the processor programmed for a method comprising the steps of a Texas hold'em game, wherein the human player folds down and the virtual players fold up such that the folded up cards are shown to the human player during play, and further comprising a half back feature that allows the human player to surrender his hole cards and stop play before the flop, in return for half of his ante back.

* * * * *